US005706254A

United States Patent [19]

Stahl

[11] Patent Number: 5,706,254

[45] Date of Patent: Jan. 6, 1998

[54] SURFACE ELEMENT AND A DEVICE FOR GENERATING SOUND

[76] Inventor: Lars Stahl, Hålsingevågen 34, Västerås, Sweden, SE-722 44

[21] Appl. No.: 737,762

[22] PCT Filed: May 19, 1995

[86] PCT No.: PCT/SE94/00571

§ 371 Date: Nov. 18, 1996

§ 102(e) Date: Nov. 18, 1996

[87] PCT Pub. No.: WO95/32601

PCT Pub. Date: Nov. 30, 1995

[30] Foreign Application Priority Data

May 19, 1994 [SE] Sweden ..... 9401761

[51] Int. Cl.[6] ..... H04R 17/00

[52] U.S. Cl. ..... 367/163; 367/174; 367/162; 367/176; 310/337

[58] Field of Search ..... 367/163, 174, 367/152, 162, 176; 310/337

[56] References Cited

U.S. PATENT DOCUMENTS

| | | | |
|---|---|---|---|
| 3,258,738 | 6/1966 | Merchant | 367/163 |
| 4,845,687 | 7/1989 | Bromfeld | 367/158 |
| 4,901,293 | 2/1990 | Kuhn | 367/168 |
| 5,016,228 | 5/1991 | Arnold et al. | 367/163 |
| 5,291,461 | 3/1994 | Boeglin et al. | 367/163 |
| 5,345,428 | 9/1994 | Arnold et al. | 367/165 |

FOREIGN PATENT DOCUMENTS

| | | |
|---|---|---|
| 2947973 | 6/1980 | Germany . |
| 2263842 | 8/1993 | United Kingdom . |
| WO9309641 | 5/1993 | WIPO . |
| WO9310644 | 5/1993 | WIPO . |

*Primary Examiner*—J. Woodrow Eldred
*Attorney, Agent, or Firm*—Notaro & Michalos P.C.

[57] ABSTRACT

A surface element for a device for generating sounds by influencing opposite extremities of a surface element to oscillate from and towards each other and thereby the surface element to oscillate transversely thereto and generate sounds has at least a portion formed in the thickness direction thereof by at least two first layers (12) and an intermediate layer (13) having a lower average density than the density of the two first layers.

32 Claims, 3 Drawing Sheets

SURFACE ELEMENT AND A DEVICE FOR GENERATING SOUND

FIELD OF THE INVENTION AND PRIOR ART

The present invention relates to a surface element for a device for generating sound by influencing opposite ends of the surface element to oscillate from and towards each other and thereby the surface element to oscillate transversely thereto and generate sound, and a device for such sound generation according to the introductory part of the independent claim as to the device.

The invention includes such surface elements of all imaginable designs, such as, for example, in the form of sealed shells or membranes extending between said two ends. In prior surface elements and devices of this kind, said influence of opposite ends of the surface elements takes place through the use of the magnetostriction or piezoelectrical effect of certain materials used in driving units influencing said ends, that is the ability of the material to alter length at it is subjected to a magnetic flow or an electrical voltage respectively between its end surfaces, and adversely, but the invention is not in any way restricted to the use of this very type of driving, but all types of driving which give the requested effect, generation of sound, are included. Thereby, by said influencing of opposite ends of the surface elements, both these ends or at least one of them may be movably arranged in order to, in the latter case, make the two ends oscillate from and towards each other through movement of just one of the ends. Furthermore, the patent claim definition "transversely thereto" includes all directions forming an angle other than 0°, accordingly not only 90°, in relation to the direction of oscillation of said opposite ends of the surface element from and towards each other.

A surface element in accordance with the one initially defined is previously known from, for example, U.S. Pat. No. 4,901,293. The surface element described therein and further surface elements of this kind appears in the shape of a continuos elliptic shell, within which several driving elements of magnetostriction or piezoelectrical material are arranged in the direction of the major axis of the shell. These are arranged in order to lengthen and to shorten in the direction of said major axis and influence end beams arranged at the ends of the major axis. Through this influence of the shell or the ends of the surface elements the motion of the driving units is transferred along the major axis of the shalt into a motion of the shell in the direction transversely thereto. These prior surface elements and devices are designed for the use in water, and they are arranged in such a way with, among other things, delimited and low transmission ratio that nor do they permit any effective and thereby commercially interesting application for the generating of sound in any other medium of a basically different kind.

The task of a surface element according to the kind initially defined is to connect the influencing motion of the driving units upon the opposite ends of the surface element to a larger area of the medium surrounding the surface element, in which medium the sound is generated, and to change this influencing motion into a motion transversely thereto to increase the moved volume of said medium. Surface elements of this kind are said to be of a flextensional type, as the end force by which they are influenced results in a bending thereof.

The problem with prior surface elements for generating sound and used in water is that they have a structure which, if they would be used for generating sound in air, does not permit the use of a high transmission ratio in combination with longer driving unit for high resonance frequency (between driving unit and surface element) in its fundamental oscillation mode, and thereby delimits the possibilities to high effects for many frequencies, which is an important disadvantage as this in itself drastically delimits the application field of the surface elements during use thereof for generating sound in air. For many frequencies, the obtaining of sufficient sound pressure in air will only be possible at the cost of the effectivity by means of substantially wider and thereby larger surface elements and thereby lower effectivity per surface unit, as a substantially larger deflection transversely to the direction of influence of the ends or larger surface elements are required in air than in water as a sound emitter radiates acoustic effect better in water than in air.

SUMMARY OF THE INVENTION

The object of the present invention is to provide a surface element and a device of the abovementioned type, which have improved properties in relation to prior such surface elements and devices and, above all, gives a substantially better effectivity per surface unit of the surface element during sound generation.

According to the invention, this object is obtained as, by such a surface element, at least one portion thereof is formed in its thickness direction by at least two first layers and an intermediate layer with a lower average density than the density of the two first layers, and provision of a device for generating sound in accordance with the enclosed, independent claim as to the device.

Through the arrangement according to the invention with at least one portion of the surface element with the two layers and a layer with a lower average density than those two layers and located there between, it becomes possible to obtain a high rigidity of the surface element at said portion, without having to give this portion a large mass. Accordingly, it becomes possible to make the surface element light and thin and still very rigid, so that the surface element can transfer large effects through a correct choice of comprised materials and be given a high transformation ratio. The possible rigidity and the lightness result in the possibility of arranging the surface element with high transmission ratio so that it maintains its fundamental oscillation mode at a high frequency and thereby high resonance effect, and thereby permits transfer of important effects, which is often requested for many applications during sound generation in air. The mass which is placed in the middle and controls the break up of the surface element and the resonance frequency, and the mass included in the end beams can be kept low and thereby the fundamental oscillation mode can be maintained high as to frequency and the resonance frequency can become high in spite of high transmission ratio, which, from experience, has proved itself to substantially influence the break up of the surface element as well as the resonance frequency of the sound generator. Experience has shown that it is the mass located in the centre, which, in combination with its high transmission ratio, is governing the resonance frequency, a fictive mass, but when having light membranes, also the mass of end beams.

Accordingly, the surface element permits a substantially higher sound effect per surface unit by permitting high transmission ratio, permits to operate in the first fundamental oscillation mode with the resonance effect thereby maintained, permits higher resonance frequency by permitting smaller width of the surface element and thereby smaller mass of the end beams and permits transfer of large effects through the ends in the movement direction of the ends of a light surface element because of resistance against pressure loading.

In a surface element of this kind, the rigidity of said portion can easily be adjusted without the mass of the surface element being affected to any substantial degree, that is a simple adjustment of the frequency of said fundamental oscillation mode and altering of the possibility to obtain a certain transmission ratio can be obtained by simply altering the thickness of said intermediate layer having a lower average density. The definition "average density" is used to explain that said intermediate layer not has to be homogenous, but it might as well comprise cavities, and that it also can be homogeneous and present certain parts with just as high or even higher density than the two first layers, as long as the average density of the intermediate layer, that is the mass of this layer divided by the total volume between said first two layers, is lower than the density of the two first layers.

Furthermore, a certain distance between said opposite ends of a surface element for high transmission ratio is required so that only one included driving unit shall be able to transfer high effects, but as the distance grows between said ends the easier the surface element breaks up, so that a low mass of the surface element is crucial to make high effects possible. Thanks to the possibility of high transmission ratio at a low dead weight, the surface element according to the invention thus permits the obtaining of high effects per surface unit.

Another advantage of the low, preferably centred dead weight with which the surface element can be provided is that the tension on the driving units generating the movements of the surface element becomes less, which permits the driving units to be made less expensive. Another advantage with the high effectivity per surface unit which can be given to the surface element is that the driving units can be made substantially smaller, which further increases the effectivity and reduces the costs of the driving units. A further advantage is that the width of the surface element can be kept low and thereby also the mass of included beams, as high beam mass results in inferior effectivity and presses down the resonance frequency. Another advantage is the resistance against pressure loading in the direction of movement of the end forces that the element can be given with a maintained low weight, which makes it possible to transfer large effects through movable end beams.

Yet another advantage of the surface element according to the invention is that it will be easy to vary the rigidity along its surface by varying the thickness of the intermediate layer, so that unwished resonance can be submitted and the acoustic be modulated.

The invention is not restricted to surface elements with high transmission ratio or frequency, but a surface element according to the invention may also advantageously be used when a surface element with a low transmission ratio or frequency is required, as it is substantially more effective than prior surface elements for sound generation in this way also at low transmission ratio and/or frequency. At the same time, the invention includes surface elements which are only used outside their main resonances, that is in frequency regions where they have broken up and where their transmission ratio is not of any considerable importance.

According to a preferred embodiment of the invention, the surface element is intended to be used for sound generation in air, all fields concerning sound generation in air being included, such as different constructions for loud speakers for speeches, HiFi etc.

According to a preferred embodiment of the invention the centre region of the surface element between said ends is light in relation to the rest of the surface elements, and the transmission ratio of the central region of the surface element is high. Particularly this combination of light, centred surface with high transmission ratio is very advantageous, and it permits obtaining a first fundamental oscillation mode at a high frequency while simultaneously high effects are transferred. Accordingly, thanks to the light, centred surface, the surface element does not break up until at high frequencies, in spite of the high transmission ratio, and simultaneously, thanks to the high transmission ratio, a high effect can be obtained.

According to another preferred embodiment of the invention, said centred region is a centre located region of the surface element, the boundaries of which have a distance to each end respectively of at least one fifth of the distance between said ends, which has turned out to be very advantageous for the obtaining of the required properties just discussed. Thereby it is desirable that said at least one portion having at least two first layers and an intermediate layer is arranged in said centre region and forms at least 10%, preferably at least 20%, and most preferably at least 30%, of the total surface of the surface element. With said at least one portion is of course meant that the central region can be provided with a plurality of such portions, possibly differently designed. Experience has namely proved that it is the centre mass in combination with its transmission ratio which is controlling the resonance frequency (by light membranes also the mass of the end beams).

According to another preferred embodiment of the invention the major part of the surface element is formed by one or more portions having at least two first layers and one intermediate layer. Such a surface element obtains a low dead weight and a high rigidity, together with the advantages which this results in and which have been discussed in detail above.

According to an other preferred embodiment of the invention the two first layers of the surface element adjoin at at least one location on the surface element, under disappearance of the intermediate layer, in order to form a so called hinge through a decrease of rigidity of the surface element accomplished by said adjoining. In this way it is possible to make the surface element rigid but still make it oscillate to an important extent.

According to another preferred embodiment of the invention, the intermediate layer of the surface element presents at least one swelling for locally increasing the rigidity of the element. In this way, the surface element can be given an extra rigidity just where such a one is required for a given application, for example to submit certain undesirable resonances, modulate the acoustics or obtain an important deflection without the surface element breaking up at a given frequency.

According to another preferred embodiment of the invention, the thickness of said first layer increases in the direction towards each of said ends respectively of the surface element, permitting the surface element to be made more rigid there than in the centre portion between the two ends. Thereby it is advantageous that said portion, presenting an intermediate layer, is located in said centre portion and that the total thickness of the surface element increases towards its ends, in order to make the surface element very strong at the ends and relatively soft in the centre and thereby permitting to stay in the first fundamental mode high up in the frequency scale, as the mass of the centre portion of the surface element is directly determining the size of said fictive mass and thereby the break up frequency of the element. Hereby, also a long distance between the ends of the surface element can be applied, and one still remains in the fundamental mode, and thus a high transmission ratio and resonance effect can be obtained without break up at low frequencies.

According to another preferred embodiment of the invention, said first layer of the surface element is made of a material having low density, the density of this material preferably being less than 2 200 kg/m$^3$. A low density of the first layers is of considerable importance for obtaining a low dead weight of the surface element, while simultaneously the rigidity is high.

According to another preferred embodiment of the invention a material with a high elasticity module in some direction is comprised in said first layer of the surface element, said elasticity module advantageously being more than $10^5$ MPa. This property of said first layer, together with the existence of said intermediate layer, is of vital importance for obtaining a required high transmission ratio at high frequency and thereby high effectivity per surface unit.

The advantages with a device according to the invention according to the enclosed independent claim as to the device are evident with the above description of the properties of the surface element according to the invention in view.

Further advantages and advantageous characteristics of the invention will be shown by the rest of the dependent patent claims and the following description.

BRIEF DESCRIPTION OF THE DRAWINGS

Hereinbelow preferred embodiments of the invention, referred to by way of example, are described with reference to the enclosed drawings, in which:

FIG. 4–13 illustrate surface elements according to different embodiments of the invention, which elements can be used in a device according to FIG. 2 or 3 for generating sound, and of which FIG. 4–6 and 9–11 are views where the surface elements extend, in the figures, in the direction form left to right between the opposite ends which are subjected to influence for generation of sound, while FIG. 7, 8, 12 and 13 are sectional views perpendicular to said direction. Here the surface elements are shown flat, but normally they are bent, even though this is not always required.

DETAILED DESCRIPTION OF PREFERRED EMBODIMENTS OF THE INVENTION

Figure 1:
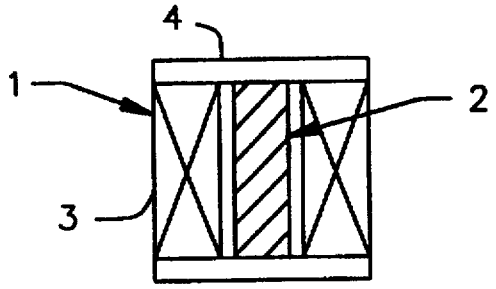
FIG. 1 is a schematic sectional view of a possible design of a driving element used in a device according to the invention.
Figure 2:
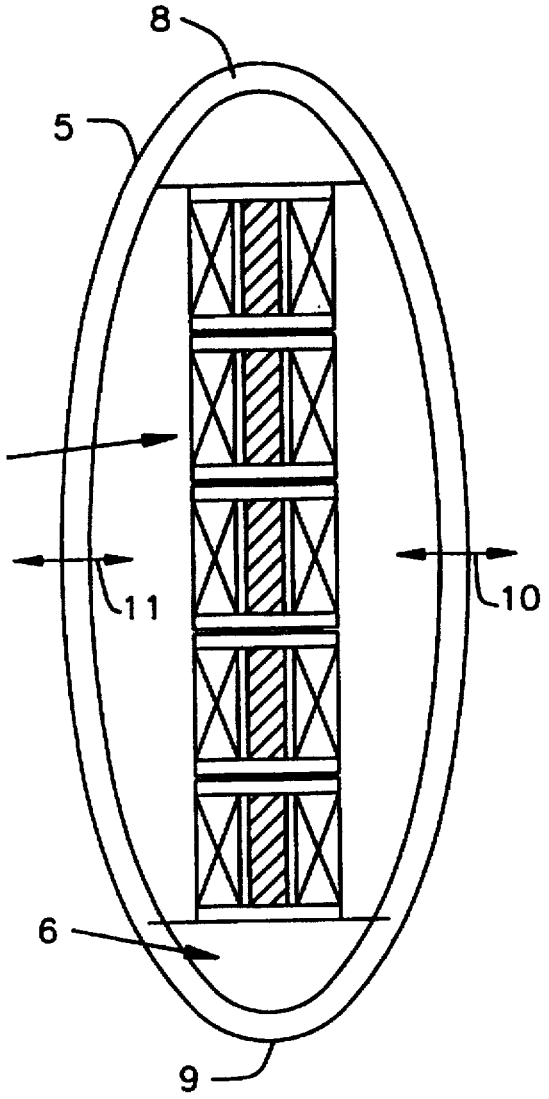
FIG. 2 is a simplified sectional view illustrating a device for generating sound of the type according to the invention from one side.
Figure 3:
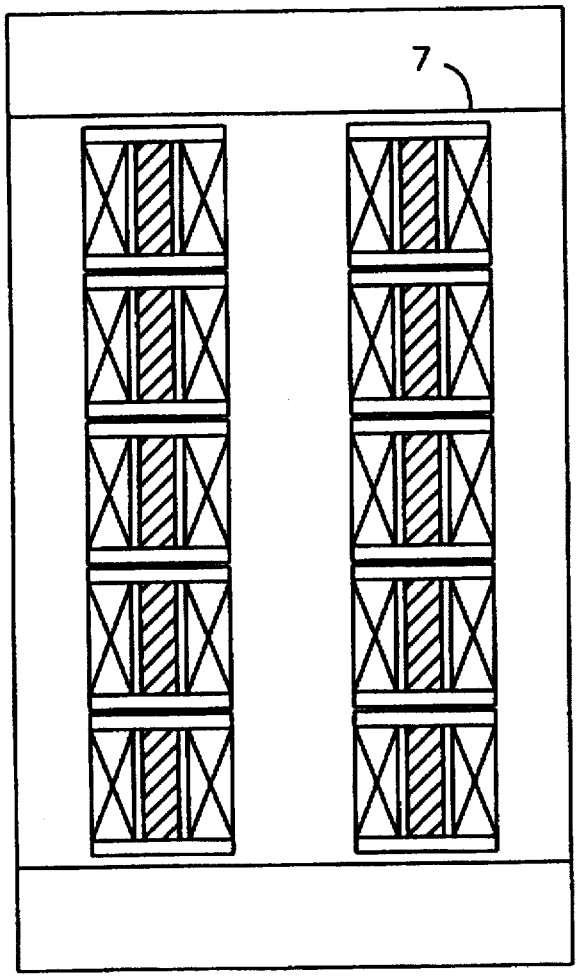
FIG. 3 is a sectional view of the device in FIG. 2, turned 90° in relation thereto.

For explaining to which type of sound generation the invention is adapted, the construction of a possible such sound generating device is very schematically illustrated in FIGS. 1–3, which device in no way is to be seen as delimiting the invention. In FIG. 1, the construction of one of several driving elements 1 comprised in the invention is shown, which element is formed by an inner driving rod 2 of a magnetostriction material, around which red a coil 3 is wounded and the opposite ends of which are delimited by permanent magnets 4. By sending a varying current in the coil 3 the magnetic flow in the driving rod 2 is varied, resulting in a length alteration of the latter being obtained. As the permanent magnets 4 premagnetise the driving rod with a stationary, permanent magnetic flow, an expanding as well as a constricting motion of the driving rod can be obtained. The driving elements 1 are arranged in two rows inside an elliptic shell forming a surface element 5, the longitudinal axis of the driving rods being colinear with the major axis of the elliptic shell. Thereby, each driving element row respectively is fixed in the shell between pieces 6, so called end beams, located at the two ends of said shell. The shell is closed so that the surrounding medium cannot get in there and nor can sound waves generated inside in the shell be spread out therefrom. During lengthening and shortening of the driving units 7 formed by the row of driving elements 1 the end beams 6, and thereby the opposite ends 8, 9 of the surface element 5, will be affected in a direction from each other and towards each other respectively while at the same time describing an oscillational motion in the direction of the major axis of the ellipse. This motion will be transferred into an oscillational motion of the surface element transversally thereto, in the direction of the double arrows 10 and 11. In this way, the motion of the driving units is connected to a larger area and the motion is transmitted so that the volume of the surrounding medium moved is increased.

Thereby, the transmission ratio of the device, during driving of one end, is defined as the quotient of the amplitude in the first fundamental oscillation mode of the maximum deflection of the surface element 5 in said transversal direction, and of the ingoing amplitude of that end divided by two. When two opposite ends are driven it is defined as the quotient of the amplitude in the first fundamental oscillation mode of the maximum deflection of the surface element 5 in said transversal direction, and of the ingoing amplitude of any end. What has been mentioned above is valid irrespective of driving effect.

As to the relative longitudinal alteration of the driving rods 2 it can be mentioned that it, typically, only amounts to the order of 1 per mille. When going from lower to higher frequencies of the oscillation of the driving units 7, initially each shell side respectively will oscillate between the two ends 8 and 9 while generally describing the shape of a single, pure deflection shape with a first resonance frequency (fundamental oscillation mode), after which the surface element 5, at a further increase of the frequency will break up and, at a higher frequency, will obtain a second resonance, (second fundamental oscillation mode), after which an increase of the frequency leads to another break up and subsequently the arrival of a third fundamental oscillation mode.

Where in the frequency band the different fundamental modes are located is much depending on the properties of the surface element 5. More precisely, the frequency of the different resonances increases with the increasing rigidity and decreasing weight of the shell, the weight of the centre portion between the ends 8 and 9 being of decisive importance.

In FIG. 1 the construction of the surface element 5 according to a preferred embodiment of the invention is illustrated, said element presenting two first layers 12 made of a material with low density, such as fibre composite material, for example carbon fibre, which is preferably baked into a matrix material made of, for example, epoxi, and a high elasticity module. With the low density is meant a density which is clearly lower than the conventional one for rigid materials, normally metals, and preferably lower than 2 200 kg/m$^3$.

Figure 4:
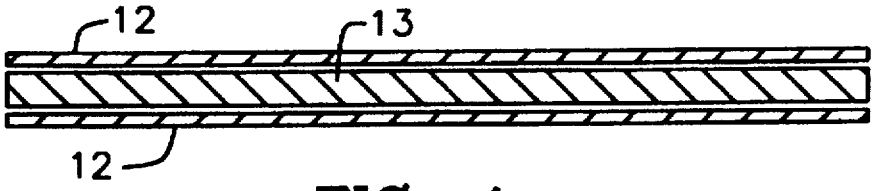

With a high elasticity module for the total first layer is meant an elasticity module in any direction, often preferably in the direction between said ends, surpassing 0,7×10$^5$ MPa, preferably surpassing 1,2×10$^5$ MPa and most preferably surpassing 1.5×10$^5$ MPa. As an example, it can be mentioned that this layer can be made of carbon fibre baked into a matrix of epoxi, the carbon fibre density being approximately 1 700 kg/m$^3$ and the density of epoxi being approximately 1 200 kg/m$^3$, the elasticity module of these two being approximately 2,1×10$^5$ MPa and 3×10$^3$ MPa respectively. It is thereby possible that the fibre composite layer contains several beds of fibres in different directions, for example according to an angular distribution with a difference of 45° depending on what properties are requested. Between the two outer first layers 12, the surface element comprises an intermediate layer 13 having a lower average density than the first layers 12. Thereby, the intermediate layer can be made of homogenous material, as shown in FIG. 4, and it presents a density which is lower than, preferably substantially lower than, and most preferably at the most ¼ of the density of the first layers. Thereby the average density of the intermediate layer 12 is preferably lower than 300 kg/m$^3$. When choosing a suitable cellular plastic as intermediate layer, the density will be approximately 200 kg/m$^3$. The intermediate layer 13 can be made of a material with a low elasticity module, such as for example approximately 1 MPa.

Thanks to the construction of the surface element with these two first layers 12 and the intermediate layer 13 with the above characteristics it is possible to obtain a very high rigidity of the surface element while maintaining a low weight while the rigidity of the surface element easily can be increased by increasing the thickness of the intermediate layer 13, so that the rigidity easily can be increased without any substantial increase of the weight of the surface element in order to make higher resonance frequencies and higher transmission ratio possible and for the possibility of higher effects per surface unit during sound generation by means of the surface element. The portion having at least two first layers and an intermediate layer advantageously contributes to 10% of the total main surface of the surface element and more preferably more than 20%, and most preferably more than 30% thereof.

The procedure as to manufacturing a device of the type shown in FIG. 2, that is with a closed shell, is as follows. As the shell is formed by a composite material, its deflection shape is easily manufactured by wounding it around a figure. Thereby, the figure is comprised by generally two parts, namely the two end beams and a unit with intermediate, deflected aluminium plates. Subsequently, the fibre material is wounded around the very end beam. During setting the fibre composite can be fixed to the end beams and loosened from the aluminium plates, in order to obtain an assembled shell construction. By this manufacturing process an exact reproductibility of shells can be obtained as to deflexion profile.

Figure 5:
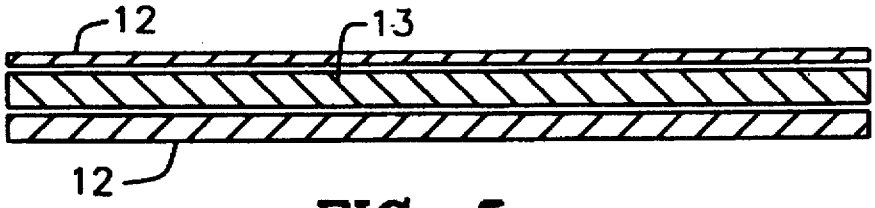
Figure 6:
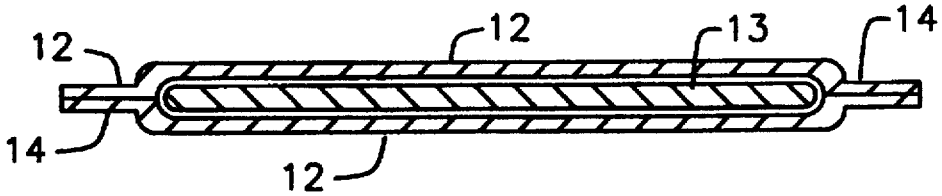

In FIG. 5, another possible design of the surface element according to the invention is shown, one of the first layers of this element being thicker than the other first layer, while in FIG. 6 it is shown how the two first layers adjoin at certain locations 14 and the intermediate layer 13 there disappears, so that the rigidity of the surface element is decreased at the locations 14 and so called hinges thereby are obtained at those locations. By using such so called hinges in the neighborhood of the ends of the surface element, which ends are adapted to be influenced by the driving units, the transmission ratio of the surface element can be increased. It is also possible to apply such hinges on any other location where it is requested that the surface element shall have a delimited rigidity against deflection and be easily deflected, for example at the middle of the shell.

Figure 7:
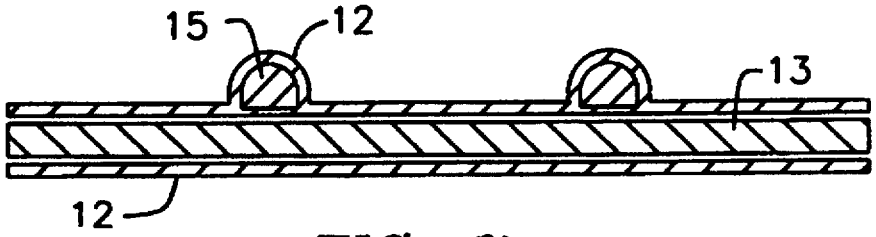

In FIG. 7 it is illustrated how the intermediate layer 13 has been made thicker at certain locations, here two, in order to locally increase the rigidity of the surface element by forming so called beam elements 13. These beam elements extend preferably generally from one of the affecting ends of the surface element to the other end, but it is also possible that such beam elements have completely different directions and lengths, if that is requested for the obtaining of or avoiding of certain resonance phenomena.

Figure 8:
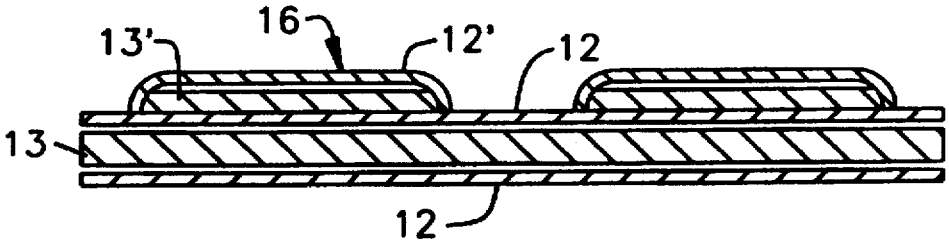

In FIG. 8 a surface element according to another preferred embodiment of the invention is shown, in which an extra first layer 12' is arranged at certain portions 16, resulting in an extra, intermediate layer 13'. These portions 16 can extend in a way corresponding to that of the beam elements 15 of the surface element illustrated in FIG. 7, and also these ones are used for locally increasing the rigidity of the surface element. However, due to the extra first layer of these portions, this will also lead to a local, obvious increase of the mass of the surface element, which, however, in certain situations can be completely in line with the existing requests. Of course it is also possible that said portions 16 extend over the whole surface element, that is the latter presents three first layers everywhere, or can the surface element also present more than three first layers, as well over its total extension as locally, all sorts of local variations of layer number being possible locally.

Figure 9:
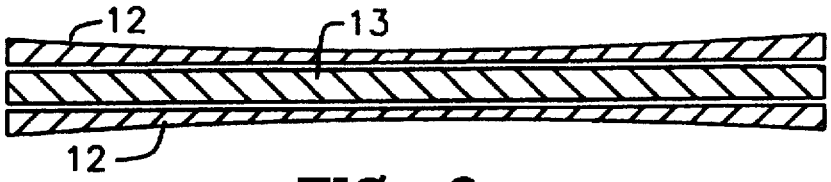

In FIG. 9 another way in which the surface element can be varied within the frame of the invention is shown, and here the first layers have been made thicker towards the ends, so that the surface element becomes stronger at the ends and is softer in the middle in relation thereto, which results in that it gets a low mass in the middle and therefor does not break up so easily, so that the first fundamental mode can be obtained at a relatively high frequency. At the same time this permits to obtain relatively high effects per surface unit, as it, for the obtaining of high effect per surface unit, is of importance to have a relatively large distance between the ends of the surface element without the mass of the surface element becoming too large, the very mass loading in the centre portion of the surface element being the characteristic of decisive impedance.

Figure 10:
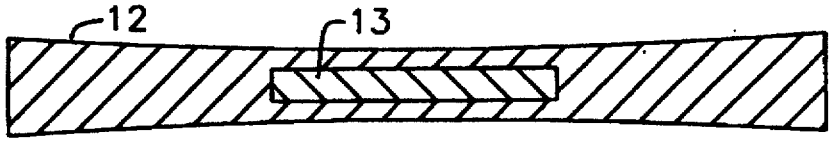

In FIG. 10 the surface element according to an embodiment is shown in which the rigidity has been increased further at the ends of the surface element by making these ones massive and of said first layer under simultaneous increase of thickness for the whole surface element. This leads to a further accentuation of the advantages of the embodiment according to FIG. 9 in certain cases it can also be advantageous to vary the thickness of the surface element by increasing the thickness in the transversal direction from a centre portion towards its side edges.

Figure 11:
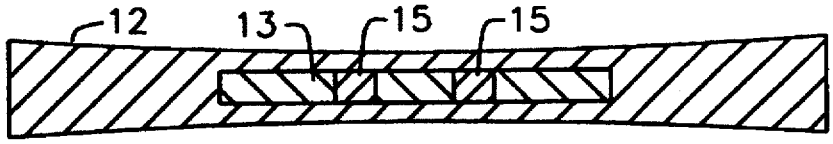

In FIG. 11 a variant of the surface element shown in FIG. 10 is shown, in which two beam elements 15 have been positioned as bridges between said two first layers, these two beam elements being made of the same material as the two first layers. Hereby, a local rigidity increase can be obtained if that would be requested.

Figure 12:
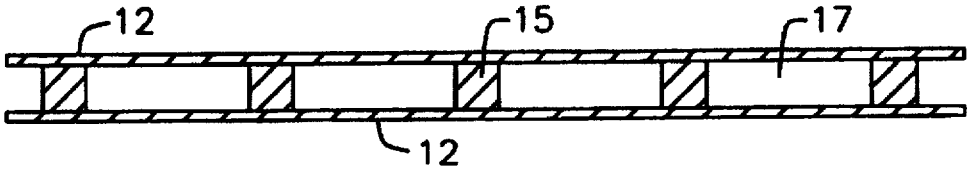

In FIG. 12 a surface element having a plurality of such beam elements 15 that connect the two first layers 12 is shown, which beam elements can have an optional extension but here extend in the longitudinal direction of the surface element from affecting end to affecting end. These beams 15 can be made of the same material as the first layers, and between the different beams the intermediate layer comprises voids 17 so that the intermediate layer has an average density which is considerably lower than the density of the first layers. The beams can also be substituted by other structures generating voids, such as honeycomb structures, for example made of aluminium.

Figure 13:
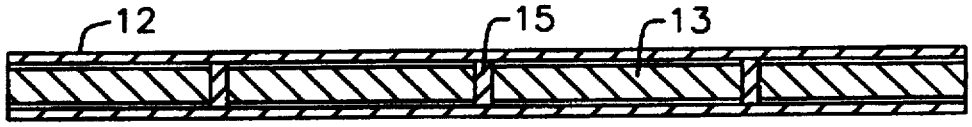

In FIG. 13 it is illustrated how beams 15 are arranged in a similar way to that in FIG. 12, but here the voids 17 are filled with a material with lower density than the material of the first layers 12. For said beams 15 of the different embodiments shown it is possible to use another material than the one of said first layer, this material even being capable of presenting a higher density than the first layers. A possible material for such beams is aluminium.

The invention is of course in no way delimited to the embodiments described above, but a plurality of possibilities to modifications thereof should be obvious for a person skilled in the art without thereby departing from the very fundamental thought of the invention.

For example the different first layers of one and the same surface element could be made of different materials.

The fact that the surface element at its ends is connected to pieces, as pointed out in the independent claim as to the device, is to be seen in a wide meaning and includes all sorts of connections, fixed as well as more or less lose or motion permitting.

For example, it would be possible to provide the surface element with folds having a beam character, for local rigidity increase, or make the whole surface element folded.

I claim:

1. A surface element for a device for generating sound by influencing opposite ends (8, 9) of the surface element to oscillate from and towards each other, thereby making the surface element oscillate transversely thereto and generate sound, characterized in that at least a portion thereof is formed in the thickness direction thereof by at least two first layers (12, 12') and an intermediate layer (13, 13') having a lower average density than the density of the two first layers.

2. A surface element according to claim 1, characterized in that its centre region between said ends is light in relation to the rest of the surface element.

3. A surface element according to claim 2, characterized in that its transmission ratio in the centre region is high.

4. A surface element according to claim 3, characterized in that said transmission ratio is higher than 6, preferably higher than 8.

5. A surface element according to any of the claims 2–4, characterized in that said centre region is a centrally located region of the surface element which substantially is located within a limited area, the boundaries of which has a distance to each end of at least ⅕ of the distance between said ends.

6. A surface element according to claim 5, characterized in that said distance is at least ¼.

7. A surface element according to any of claims 2, characterized in that said at least one portion having at least two first layers (12, 12') and in intermediate layer (13, 13') is arranged in said centre region and forms at least 10% of the total area of the surface element.

8. A surface element according to claim 7, characterized in that said at least one portion forms at least 20%, preferably at least 30%, of the total area of the surface element.

9. A surface element according to claim 8, characterized in that said at least one portion forms generally 50% of the total area of the surface element.

10. A surface element according to claim 1, characterized in that the major part thereof is formed by one or more of said portions having at least two first layers (12, 12') and an intermediate layer (13, 13').

11. A surface element according to any of claims 1, characterized in that the two first layers (12) adjoin at at least one location (14) under disappearance of the intermediate layer, in order to form a so called hinge at said location through a reduction of rigidness of the surface element obtained through said adjoining.

12. A surface element according to claim 11, characterized in that it is provided with such a location (14) for adjoining of the two first layers (12) in the neighbourhood of at least one of said ends (8, 9) of the surface element.

13. A surface element according to any of claims 1, characterized in that the intermediate layer (13) presents at least one swelling (15) for local increase of the rigidity of the element.

14. A surface element according to any of claims 1, characterized in that the intermediate layer (13, 13') is homogenous.

15. A surface element according to any of claims 1, characterized in that the intermediate layer (13) comprises cavities (17).

16. A surface element according to claim 14, characterized in that at least one bridge (15) which connects the two first layers (12) extends through the intermediate layer (13).

17. A surface element according to claim 16, characterized in that said bridge is formed by the same material as said first layer.

18. A surface element according to claim 16, characterized in that said bridge (15) has a beam-like character and a longitudinal direction which goes generally in the direction from one of the ends (8, 9) of the surface element to the other end thereof.

19. A surface element according to any of claims 1, characterized in that it comprises at least one portion (16) with more than two first layers (12, 12') and, between each first layer respectively, intermediate layers (13, 13') having a lower average density than the density of said first layers.

20. A surface element according to claim 2, characterized in that it presents at least one portion having at least two first layers (12) and one said intermediate layer (13) only in the centre region between said ends of the surface elements.

21. A surface element according to any of claims 1, characterized in that said first layer (12) has a varying thickness.

22. A surface element according to claim 21, characterized in that the thickness of the first layers (12) increases in the direction towards each of said ends (8, 9) respectively of the surface element.

23. A surface element according to any of claims 1, characterized in that said first layer (12, 12') is made of a material with a low density.

24. A surface element according to any of claims 1, characterized in that a material with high elasticity module is a part of said first layer (12, 12').

25. A surface element according to claim 23, characterized in that the density of the material of said first layer (12, 12') is less than 2 200 $kg/m^3$.

26. A surface element according to claim 24, characterized in that the elasticity module of a material comprised in said first layer (12, 12') is higher than $1,5\times10^5$ MPa.

27. A surface element according to any of claims 1, characterized in that the average density of the intermediate layer (13, 13') is substantially lower than the density of the material of said first layer (12, 12').

28. A surface element according to claim 27, characterized in that the average density of the intermediate layer (13, 13') is less than a quarter of the density of the material of said first layer (12, 12').

29. A surface element according to any of claims 1, characterized in that said intermediate layer (13, 13') is at least partly formed by a material having a low elasticity module.

30. A surface element according to any of claims 1, characterized in that the first layers (12, 12') are formed by fibre composite material.

31. A surface element according to any of claims 1, characterized in that it is arranged to be used for the generation of sound in air.

32. A device for generating sound, which comprises a surface element (5) in which two opposite ends (8, 9) are intended to be connected to a piece (6) each, and a driving unit (7) arranged to influence said pieces and thereby the ends of the surface element to oscillate from and towards each other and thereby the surface element to oscillate transversely thereto and generate sound, characterized in that at least one portion of said surface element is formed in the thickness direction thereof by two first layers (12, 12') and an intermediate layer (13, 13') with a lower average density than the density of said two first layers.

* * * * *